United States Patent [19]

Hardman et al.

[11] 4,013,386

[45] Mar. 22, 1977

[54] POSITIVE DISPLACEMENT METERING PUMP

[75] Inventors: James V. Hardman, N. Caldwell; Norman S. Wolfman, Cranford, both of N.J.

[73] Assignee: Hardman Incorporated, Belleville, N.J.

[22] Filed: Sept. 8, 1975

[21] Appl. No.: 611,507

[52] U.S. Cl. ..... 417/489; 92/168; 417/900

[51] Int. Cl.[2] ..... F04B 7/04

[58] Field of Search ..... 417/489, 177, 437, 900; 92/168, 128; 222/409; 277/205, 9, 236, 182, 183

[56] References Cited

UNITED STATES PATENTS

| | | | |
|---|---|---|---|
| 1,771,596 | 7/1930 | Victor | 277/9 X |
| 2,212,138 | 8/1940 | Wright et al. | 277/236 X |
| 2,569,903 | 10/1951 | Santarelli | 222/377 X |
| 2,997,318 | 8/1961 | Lansky et al. | 277/205 X |
| 3,022,097 | 2/1962 | Seniff et al. | 277/9 X |
| 3,199,831 | 8/1965 | Sully | 277/205 X |
| 3,233,554 | 2/1966 | Huber et al. | 417/534 X |
| 3,318,251 | 5/1967 | Smith | 417/385 X |
| 3,675,933 | 7/1972 | Nappe | 277/9 |
| 3,802,805 | 4/1974 | Roeser | 417/437 X |
| 3,913,460 | 10/1975 | Wright | 92/85 R |

*Primary Examiner*—William L. Freeh
*Assistant Examiner*—Edward Look
*Attorney, Agent, or Firm*—Stefan J. Klauber

[57] ABSTRACT

A metering pump including a pump body having a bore for receiving a flowable composition to be dispensed, feed inlet means communicating with the bore, and spaced outlet means including a check valve, for discharging the composition. A pressure chamber is defined intermediate the pump inlet and outlet. The chamber has an inlet, and an outlet communicating with the pump outlet through the check valve. A piston is mounted for axial reciprocation in the bore between a first position at which the piston is withdrawn from the pressure chamber inlet, and a second position at which the piston passes at least partially into such inlet. The pressure chamber inlet is bounded by sealing means including an annular sealing surface which converges in the direction of the pressure chamber, to a diameter less than that of the piston, whereby the surface may slideingly engage and seal with the piston upon the latter entering the pressure chamber. The sealing surface is elastically dilateable away from the axis of the bore, to maintain the seal about the piston during its entry and withdrawal from the pressure chamber and to enable compensation for wear. At least one other surface of the sealing means is accessible to the pressure chamber interior, and is elastically coupled to the backside of the sealing surface. In consequence, the increasing pressure developed by movement of the piston into the pressure chamber, acting through the accessible surface, increases the sealing forces between the sealing surface and piston.

14 Claims, 16 Drawing Figures

POSITIVE DISPLACEMENT METERING PUMP

BACKGROUND OF INVENTION

This invention relates generally to pumping apparatus, and more specifically relates to positive displacement pumps of the type utilized in dispensing metered quantities of flowable liquid compositions, such as, for example, epoxy resins or so forth.

In the course of dispensing flowable liquid materials, such as, for example, epoxy resins, metering pumps are commonly utilized, which are based upon displacement of some type of piston element a predetermined distance within a pressure chamber. The material to be dispensed is initially provided to the said chamber, so that for each movement of the piston a specified amount of the liquid material may be thus dispensed through a suitable outlet. It is command and well-known further, to utilize a plurality of such pumps in tandem, in those instances where it is desired to simultaneously dispense measured quantities of two or more components of a multi-component composition. Such is the case, for example, with the common epoxy resin systems, where one desires to dispense simultaneously the resin and a catalyst for same.

In applications of the aforementioned type, key requirements for the pumping device are simplicity of operation and dependability; and moreover, because the said pumps can be in semi-continuous, if not virtually continuous use, it is most important that they require an absolute minimum of down-time for maintenance, repair, or so forth.

A highly significant problem that has been evident in the prior art with respect to this type of devices, derives from the requirement for providing appropriate sealing between the sideable piston element, and the chamber volume which is pressurized in response to the piston movement. The sealing means utilized for these purposes should not only provide effective sealing action, but further, should have such characteristics as will enable it to operate in the stated environment for sustained periods without requiring replacement. Further, should such replacement be required, the operation ought be conductable in a simple manner, preferably with minimization of down-time. It may be noted here that the problem of wear for this sealing means is particularly acute in many of the applications to which the present invention appertains, in that numerous of the epoxy and related compositions, are characterized by included fillers which take the form of finely dispersed quartz, fine sand, or so forth. These fillers, while serving admirable and necessary funtions in the dispensed compositions, are so thoroughly abrasive as to wear conventional sealing means at an alarming rate, which in turn requires replacement of such conventional seals at very frequent intervals.

Typically, for example, O-rings or similar solid cross-section sealing means have been utilized in the prior art in order to produce adequate sealing in the mentioned environment. An arrangement of this type, for example, is shown in U.S. Pat. NO. 3,802,805 which indeed discloses a typical example of a prior art type of device upon which the present invention improves. During piston displacement a high radial load is impressed on the O-ring seal; thus the sealing action is basically effected by section deformation of the said O-ring. Such approach, however, necessarily produces high friction and temperatures, with consequent high wear. Since, further, seals of this type provide no mechanism enabling substantial compensation for the said wear, the seals necessarily display a very short service life.

A further significant problem that has been noted in the prior art pertinent to the type of metering pumps considered herein, derives from the fact that numerous of the compositions with which apparatus of this type are utilized, are highly viscous in nature as, for example, many of the epoxy system components alluded to. As will be evident to those familiar with the present art, it is essential that a positive displacement metering pump include appropriate mechanisms as to assure that a full "shot" of the flowable composition is provided to the pressure chamber prior to displacement of the piston therein. Thus, voids within the "filled" chamber cannot be tolerated to any substantial degree, or unacceptable performance will ensue. Here, however, it may be noted that numerous of the prior art pumps intended for metering viscous materials have required use of unduly complex mechanisms for assuring complete filling of the pressure chamber, which mechanisms in turn have lent undue complexity and cost to the apparatus.

In accordance with the foregoing, it may be regarded as an object of the present invention, to provide a metering pump for dispensing measured quantities of a liquid composition, which includes sealing means which coact with a displaceable piston during pump actuation, as to provide effective sealing between the piston and a pressurization chamber from which the composition is expelled; and wherein the sealing arrangement is yet such that compensation for seal wear automatically occurs, thereby increasing the service life of the seal, and minimizing requirements for replacement or repair of same.

It is a further object of the present invention, to provide a metering pump particularly adapted for dispensing measured quantities of flowable liquid compositions, wherein features are incorporated enabling the sealing means between pressure chamber and moveable piston to be manually interchanged with standby seals of the same type, without requiring disassembling of the pump; and wherein the interchange operation renders the worn sealing means accessible for replacement without interfering with pump operation.

It is a yet further object of the present invention, to provide a metering pump, particularly adapted for dispensing measured quantities of viscous liquid compositions such as epoxy resins, or the like, which is so structured that the operation thereof assures provision of full shots of the viscous composition to the pressure chamber from which such composition is expelled.

SUMMARY OF INVENTION

Now in accordance with the present invention, the foregoing objects, and others as will become apparent in the course of the ensuing specification, are achieved in a metering pump including a pump body having a bore for receiving the liquid composition to be dispensed; feed inlet means communicating with the bore for providing the composition to the bore; and spaced outlet means including a check valve for discharging the composition from the pump. A pressure chamber is defined intermediate the pump inlet and outlet. The said chamber has an inlet, and an outlet communicating with the pump outlet through the check valve. A piston is mounted for axial reciprocation in the bore between a first position at which the piston is withdrawn from the pressure chamber inlet, and a second position at which the piston passes at least partially into the pressure chamber inlet.

In accordance with a principal aspect of the invention, the pressure chamber inlet is bounded by sealing means including an annular sealing surface which converges in the direction of the pressure chamber, to a diameter less than that of the piston, whereby the surface may slideingly engage and seal with the piston upon the latter entering the pressure chamber. The sealing surface is elastically dilateable away from the axis of the bore, to maintain the seal about the piston during its entry and withdrawal from the pressure chamber and to enable compensation for wear. At least one other surface of the sealing means is accessible to the pressure chamber interior, and is elastically coupled to the backside of the sealing surface. In consequence, the increasing pressure developed by movement of the piston into the pressure chamber, acting through the accessible surface, increases the sealing forces between the sealing surface and piston.

Aside from the highly effective sealing action achieved by virtue of the construction set forth, the aforementioned sealing means is able to automatically compensate for wear, and hence may be utilized for relatively long periods of service without requiring repair or replacement.

In accordance with a further aspect of the invention, the sealing means is preferably carried by a slideable member, which is transversely displaceable with respect to the bore. The slideable member includes a plurality of sealing means, and the member is manually displaceable by an operator of the pump so as to position one of the said plurality of sealing means at the pressure chamber inlet while at least one other sealing means is positioned external of the pump body. In consequence while one of the sealing means is in use, a previously worn seal may be replaced; and similarly a worn seal may, in virtually instantaneous fashion, be withdrawn from the pump body, and replaced with a new seal -- via simple manual displacement of the slideable member.

BRIEF DESCRIPTION OF DRAWINGS

The invention is diagrammatically illustrated by way of example, in the drawings appended hereto, in which:

FIG. 12 is an external perspective view, showing a pair of pumps in accordance with the invention, being utilized in a tandem arrangement for dispensing a resin system or the like;

DESCRIPTION OF PREFERRED EMBODIMENT

Figures 1, 2:
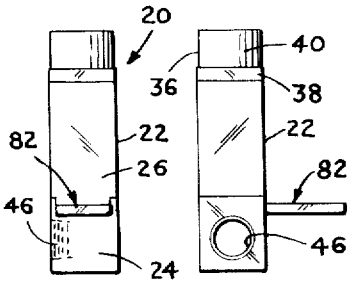
FIG. 1 is a front elevational view of a pump in accordance with the present invention.
FIG. 2 is a side elevational view of the FIG. 1 pump.
Figure 12:
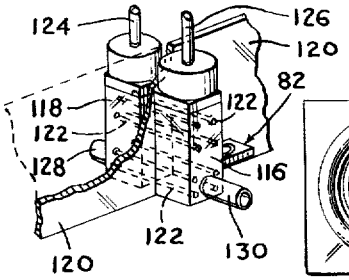

Referring initially to FIGS. 1 through 7 of the drawings, a metering pump 20 in accordance with the invention is set forth, which pump is especially suitable for use in dispensing flowable liquid compositions — such as the components of an epoxy resin system, or so forth. Pump 20 is defined by a pump body 22, which includes a lower rectangular block 24, which interfits with an upper rectangular block 26. In particular, a pair of lateral portions 28 and 30 extend upwardly from lower block 24 where they engage in press-fit fashion with recessed ledges 32 and 34 provided at the bottom of block 26. The pump body 20 is completed by a cylindrically shaped valve housing 36, which includes a valve mounting plate 38 and an end cap 40. Housing 36 is secured to upper block 26 by means of threaded fasteners 37 which pass through valve housing 36 and into the walls of block 26.

Figure 3:
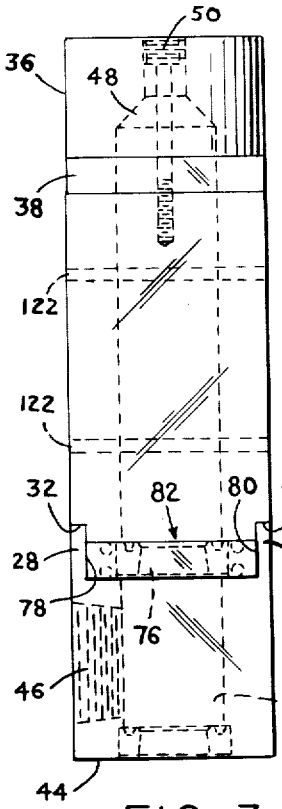
FIG. 3 is an enlarged front elevational view of the said pump, with certain internal features thereof appearing in shadow.
Figure 4:
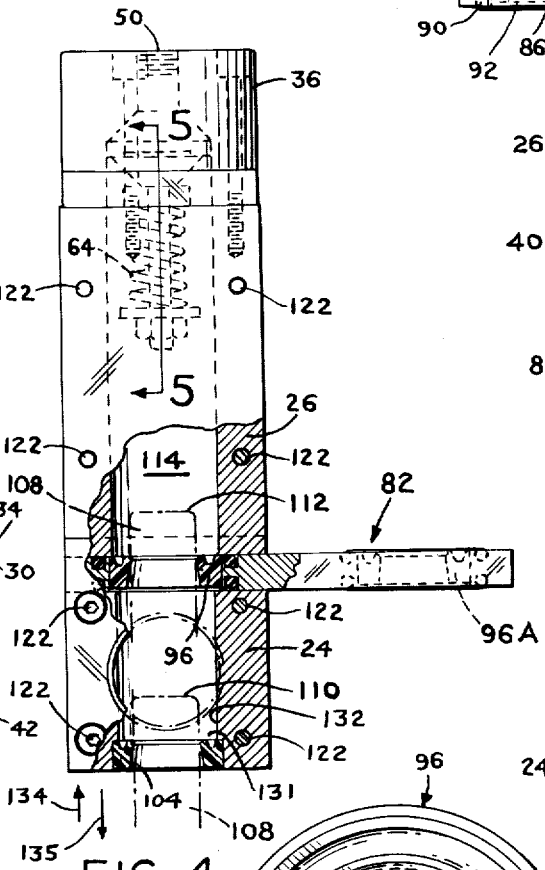
FIG. 4 is an enlarged side view of the said pump, the view being partially sectioned to show certain features of same.
Figure 6:
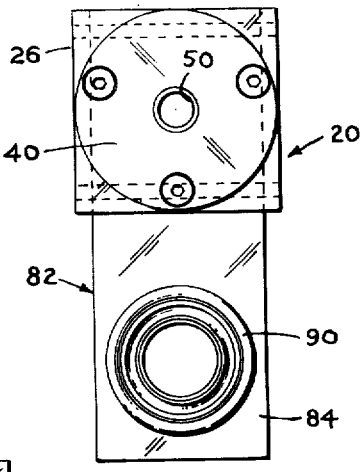
FIG. 6 is a top plan view of the said pump.
Figure 7:
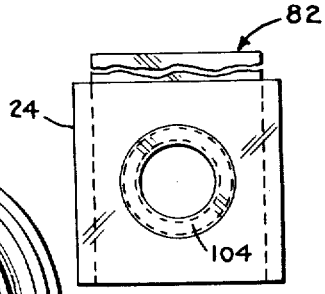
FIG. 7 is a bottom plan view of the said pump.
Figure 10:
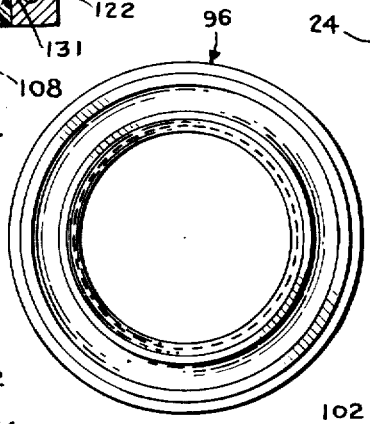
FIG. 10 is a top plan view of a sealing means carried by the slideable member of FIGS. 8 and 9.

As best seen from FIGS. 3 and 4, the pump body 22 includes a bore 42, which extends from the bottom end 44 of body 22 into the end cap 40. The lower rectangular block 24 includes at one side thereof an inlet port 46 which communicates with bore 42 and enables the flowable material being handled by pump 20 to enter the said bore. Bore 42 is further tapered at 48 toward a threaded pump outlet port 50. An outlet tube, not forming part of the present device, may be threadingly received at outlet 50 where such tube serves to dispense the liquid flowable compositions being handled by the present pump to an appropriate utilization point.

Figure 5:
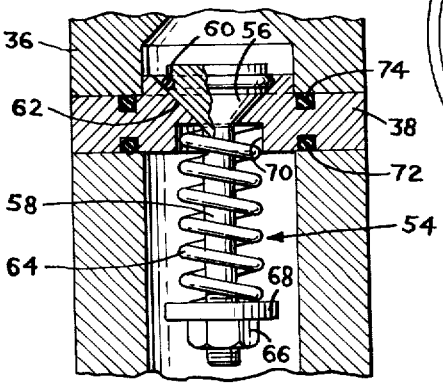
FIG. 5 is a cross-sectional view taken in the vicinity of the pump check valve, the view being along the line 5—5 of FIG. 4.

Referring particularly to the enlarged cross-sectional view of FIG. 5, which is taken along the line 5—5 of FIG. 4, details of the check valve 54, forming part of the present apparatus, are set forth. Valve 54, in particular, is seen to include a valve body 56, and a stem portion 58 extending downwardly therefrom. Body 56 includes an O-ring 60 maintained in a seating groove formed thereabout. When th valve is in its closed position, O-ring 60 seats against the valve seal 62 formed about an upper face of valve mounting plate 38. Valve 54 is normally biased to a closed position by means of a spring 64, the tension of which may be adjusted by means of the adjusting nut 66 — which bears against a retaining washer 68, positioned between the nut and a spring-receiving recess 70 formed in plate 38. The plate 38 is also seen to carry on opposite faces thereof, O-rings 72 and 74, which serve to seal plate 38 between the upper block 26 and end cap 40. It will, of course, be evident that valve 54 serves as a check valve for the flowable liquid composition — which during pumping will pass in an upward direction in the sense of FIG. 5.

Figure 8:
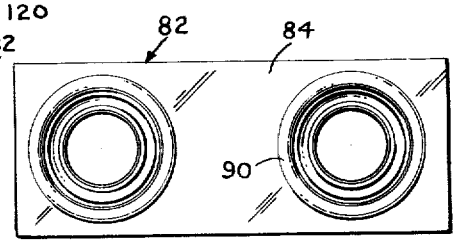
FIG. 8 is a plan view of the slideable seal-carrying member, forming part of the present pump.
Figure 9:
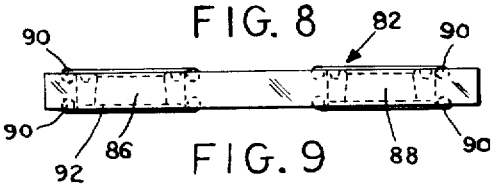
FIG. 9 is a side view of the seal-carrying member of FIG. 8.

It will be seen from FIGS. 3 and 4 that by virtue of the interfit between lower and upper blocks 24 and 26, a parallel-epiped-shaped opening 76 extends transversely through body 22. The opening 76 is thus bounded on opposite sides by flat, parallel-extending surfaces 78 and 80. Opening 76 serves to accommodate a displaceable, or slideable member 82, which member is seen in greater detail in the plan and side views of FIGS. 8 and 9, herein. In accordance with a principal aspect of the present invention, the displaceable member 82 carries a plurality of sealing means thereon. Referring in particular to the cited FIGS. 8 and 9, member 82 is seen to comprise a rectangularly shaped plate 82, having a pair of circular openings 86 and 88, spaced with respect to one another along the principal axis of the plate. Each of these openings are surrounded, on both upper and lower sides of plate 84, by O-rings 90, which, as will become evident in connection with FIGS. 3 and 4, serve to seal plate 84 at one of the openings 86 and 88, between upper block 26 and lower block 24 of pump body 22.

Each of the circular openings 86, 88, has a ledge-like portion 92 toward the bottom thereof, which serve to receive and support the bottom face 94 of a sealing means 96. Sealing means 96 are thus received within openings 86 and 88 in a press-fit fashion, and are thus effectively retained in the said openings.

Sealing means 96 is per se a conventional device, and may comprise one of various types which have been commercially available for a number of years — but which have in the past been primarily utilized in connection with shaft sealing applications. The embodiment of sealing means 96 which appears in FIGS. 1 through 13 herein, is thus a so-called "U-cup" type seal. These U-cup type seals, when utilized in the present invention, are typically formed of an elastomeric material such as a polyurethane, or of a silicone or butyl polymer, of ethylene propylene rubber (EPR), or of other elastomeric polymers, which are selected to be compatible with the compositions being handled by pump 20 and has to have the mechanical characteristics required thereof. A suitable seal of this type for use in the invention may, for example, be molded of polyurethane, and is available from Disogrin Industries, Manchester, N. H. 03103.

Figure 11:
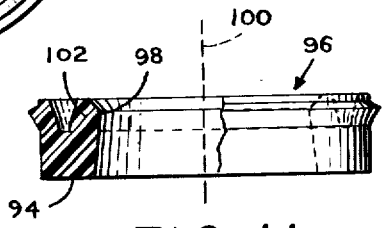
FIG. 11 is a side view, partially in cross-section, of the sealing means of FIG. 10.
Figure 13:
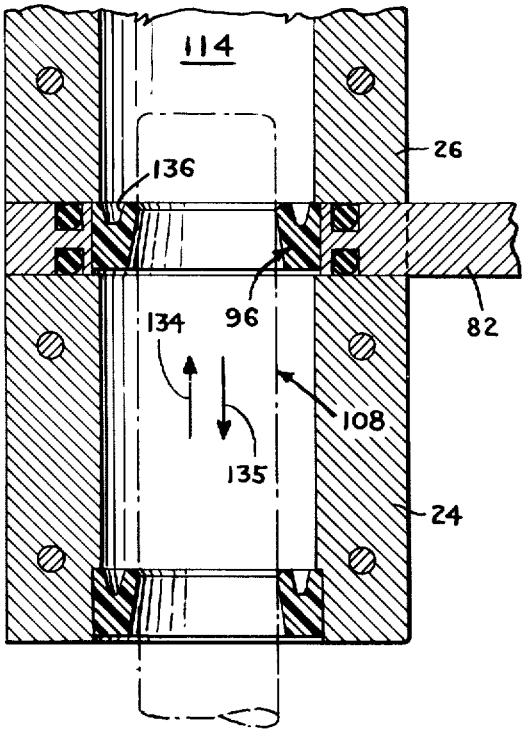
FIG. 13 is an enlarged view, partially schematic in nature, showing the piston portion of the pump entering the pressure chamber thereof.

The U-cup type seal of which sealing means 96 is representative, are characterized by inclusion of a sealing surface defined at a flexible annular lip. The lip, in its neutral condition, is displaced toward the axis of the annular seal, whereby the radially inwardmost portions of the lip converge toward the seal axis, and constitute a sealing surface for the shaft or other element which is positioned within the central opening of the seal. The lip referred to, in the present instance, is thus seen at 102, and the associated sealing surface at 98 (FIGS. 11 and 13). The lip 102 is, as mentioned, inclined toward the axis 100 of sealing means 96, and is capable of elastic flexure away from such axis. The significance of this arrangement will become further evident in connection with the discussion to be had with reference to FIGS. 4, 13 and 14 hereinbelow.

A similar seal 104 to that described in connection with FIGS. 8 through 11 is utilized at the piston-receiving opening 106 at the bottom end 44 of pump body 22. A piston 108 passes into pump body 22 through seal 104. Piston 108 comprises a simple member of cylindrical cross-section, and is driven (by motor means not shown) as to enable reciprocation thereof between the piston position 110, at which it is completely withdrawn behind sealing means 96 (and also generally rearward of inlet port 46), and a second position 112 — at which the piston passes through sealing means 96 and into a space which constitutes a pressure chamber 114 — i.e. a volume in which the liquid composition to be dispensed is pressurized and displaced by the said piston.

With the aid of the foregoing description, the operation of pump 20 may now be set forth. Firstly, in this connection, reference may usefully be had to the perspective view of FIG. 12 which illustrates a pair of pumps 116 and 118 — in a typical arrangement where an epoxy system is to be dispensed. The pumps are thus arranged in tandem, each being secured to an intermediate plate 120 by means of fasteners 122 which run through the peripheral portions of blocks 24 and 26 of each of the said pumps, and through plate 120. When the fasteners, which may consist of a threaded fastener and a mating nut, are tightened, it will be evident that the components of each pump are rigidly associated with one aother — which is to say that the blocks 26 and 24 (which otherwise would be held only by means of a press-fit) are then rigidly associated with one another. The view of FIG. 12 also shows a pair of tubes 124 and 126 inserted at the outlet ports 50, so that the resin and catalyst (or other combinations as may be desired) can be dispensed by the respective pump. Similarly, input tubes 128 and 130 are shown threaded into the inlet ports 46, to enable feed-in of the liquid composition to each of the said pumps 116 and 118.

Referring now to the view of FIG. 4, it may be assumed that piston 108 is initially in the position 110, i.e. in its withdrawn position. For reasons as will shortly become evident, liquid composition to be dispensed is drawn into the inlet 46, and in general, fills (or at least tend to fill) the portions of bore 42 which reside above piston postion 110. The piston 108, as already mentioned, is generally in the shape of a cylindrical bar. It will be noted that clearance 130 is present between piston 108 and the interior walls 132 of bore 42, even as the piston advances in the direction of arrow 134. This clearance 130 is of significance in the sort of appliations to which the present device appertains, particularly since, as already indicated, many of the compositions to be dispensed include highly abrasive fillers as, for example, of quartz. Were the piston to tightly interfit against the walls of bore 42, excessive wear of the contacting surfaces could ensue.

The piston 108 now advances in the upward direction of arrow 134, and passes into and through the sealing means 96, eventually reaching the uppermost position 112. The portions of bore 42 which reside above sealing means 96, and up to check valve 54 may be regarded as constituting a pressure chamber 114 for the liquid composition which is to be expelled by the pump. The peculiar and specific function served by the sealing means 96 may now best be appreciated by considering the enlarged view of FIG. 13.

Firstly, it will be appreciated that sealing surface 98 converges in the direction of pressure chamber 114 to a diameter less than that of piston 108. Accordingly as piston 108 enters pressure chamber 114 it contacts and engages with sealing surface 108. It will also be evident that the lip portion 102 of sealing means 96 is able, by virtue of its specific contruction, to undergo radial flexure so as to elastically dilate about piston 108 and maintain a firm seal against the walls of the advancing piston. The flexure further, need not be uniform about the entire lip, but can vary somewhat by sections, in accordance with irregularities in the piston, and (especially) to provide a degree of accommodation for abrasive particles or the like, such as have been previously mentioned.

The sealing action provided by virtue of the elastic, flexural action mentioned, differs in a most fundamental way from the type of sealing action provided with O-rings, the latter undergoing what is known in the art as a "section deformation". In the present construction the lip 102 may dilate or flex to a considerable degree without in any way impairing the structural integrity of the elastomeric material of which it is comprised. As wear occurs the minimum I.D. of the sealing means 96 (without piston 108 present) will, of course, gradually increase. But so long as the said I.D. is still less than the O.D. of the piston, effective sealing will continue. Thus the elastically dilateable nature of the seal assures an extended service life by providing compensation for wear.

Continuing to refer to FIG. 13, it is most important to appreciate that the radially outward side of lip 102 in the present instance, is accessible to the liquid which is trapped within pressure chamber 114 as piston 108 advances in an upward direction. The consequence of this construction is that the increasing pressure within chamber 114 acts at the said radially outward side 136, so as to increase the sealing force between means 96 and piston 108 as the latter advances in upward direction 134, thereby assuring a completely satisfactory seal.

It will further be evident, that as piston 108 continues its upward advance in the direction of arrow 134, the rising pressure within pressure chamber 114, reaches a point at which check valve 54 is opened — whereupon a quantity of viscous liquid is diepensed in accordance with the stroke of the piston. Upon reaching the end of its upward stroke, the motor means driving the piston 108 effects reversal of the direction of movement thereof, whereupon the piston begins to withdraw (in direction 135) towards its final lower position 112. Check valve 54, of course, immediately closes as withdrawal begins; and it will be evident that a partial vacuum is established within the pressure chamber 114 as the piston continues to withdraw. Further, as piston 108 withdraws through and below the sealing means 96 and toward its final position 112, liquid composition will be drawn through inlet port 46 and into bore 42 by virtue of the partial vacuum alluded to. Provided that the liquid composition is characterized by good flow characteristics, the bore 42 at this point, is thus filled with the liquid — which is subsequently expelled by the process just described, i.e. expelled by the next upward movement of piston 108 in the direction of arrow 134.

In connection with the foregoing, it should be appreciated that the present construction and mode of operation, according to which the piston 108 completely withdraws from sealing means 96 to the position 110, has important consequences where highly viscous compositions are being handled by pump 20. In particular it will be appreciated by those skilled in the present art, that the resistance offered to flow by such viscous compositions (which include certain of the resin components with which apparatus of the present type is likely to be utilized), can be sufficiently high as to create serious problems during filling of chamber 114. In the present construction, filling of chamber 114, as already mentioned, is initiated by the partial vacuum generated by withdrawal of piston 108 to its position 110. A highly viscous composition, however, may not flow with sufficient rapidity to completely fill the said chamber before the piston begins its return stroke — thus creating the possibility of voids within the said chamber. In the present construction, however, the movement of piston 108 between its position 110 and its entry through sealing means 96, pushes a pressure wave before it, and thus tends by such movement to deliver additional of the liquid composition through the central opening of the sealing means 96 into chamber 114 in advance of the piston — to thereby completely fill any possible voids that may be present in such chamber.

Figure 14:
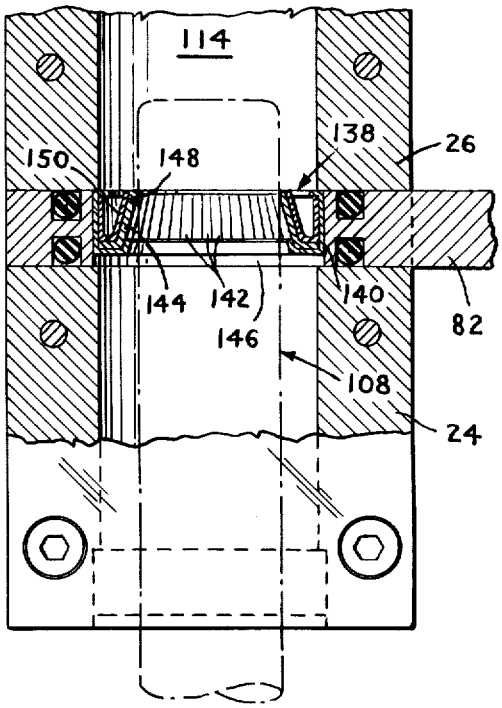
FIG. 14 is a further enlarged view, partially schematic in nature, the view being similar to FIG. 13, but illustrating the invention being utilized with a further type of sealing means.

As has already been indicated, the specific sealing means 96 thus far described, is merely one of a general class of seals utilizable herein. A seal of differing construction details, but operating herein on the same basic principle, is shown utilized with the invention in FIG. 14 herein. In this instance the seal 138 is of the so-called "Garlock" configuration, a seal of the type indicated being available from the Garlock Corp. of Rochester, New York. This seal 138, as is known to those familiar with the art, includes a steel outer shell 140, and a series of independently flexible steel fingers 142. Fingers 142 act in the nature of resilient spring elements, to maintain a radially directed bias against the sealing element itself — which constitutes an elastomeric boot 144. It will thus be noted that the characteristics previously described with reference to sealing means 96, again are present in seal 138. Seal 138 is maintained in a circular recess 146 formed in the displaceable member 82 in a manner similar to that described in connection with FIGS. 8 through 11 — except that the press fit in the present instance is against the steel shell 140. It will further be seen, of course, that the action effected during piston movement, occurs in a precisely identical fashion where the seal of FIG. 14 is utilized. This is to say that the lip 148 flexes inwardly against piston 108 — with the pressure within chamber 114 acting against the surface of radially outward side 150 of lip 148.

Figure 15:
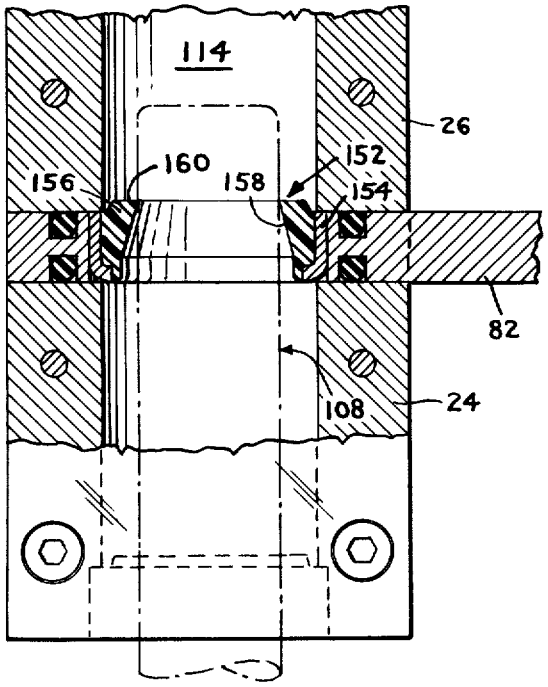
FIG. 15 is a further enlarged view, similar to FIG. 13, illustrating the invention being utilized with a third type of sealing means.

In FIG. 15 a view appears, which is similar in nature to FIGS. 13 and 14, except that a further sealing means 152 is utilized in accordance with the invention. The sealing means 152 differs from the sealing means heretofore considered, in that it is not of the so-called U-cup type. However, its mode of operation in the present invention, is similar to that of the seals heretofore considered.

In particular the sealing means 152 includes a steel outer shell 154, to which is secured an elastomeric seal 156. A seal of this general type is available from Albert Trostel Packings Ltd. of Lake Geneva, Wisconsin, under the designation "Type EB". Sealing means 152 is mounted in press-fit fashion in slide member 82, exactly as has been previously described.

It will be noted that the sealing surface 158 of elastomeric seal 156 includes the precise characteristics of previous sealing surface considered herein, namely, such surface converges toward the pressure chamber. It will further be clear that as the piston 108 advances through sealing means 152, and engages and seals with surface 158, pressure begins to build up in chamber 114. In the present instance, since the sealing means is not of the U-cup type, the increasing pressure may not act directly at the backside of surface 158. However, the mode of operation is predicated on similar principles, in that the increasing pressure acts at the surfaces 160 which are accessible to chamber 114, and the forces thus generated are transmitted through the body of elastomeric seal 156, so as once again increase the contact force between piston 108 and surface 158.

Figure 16:
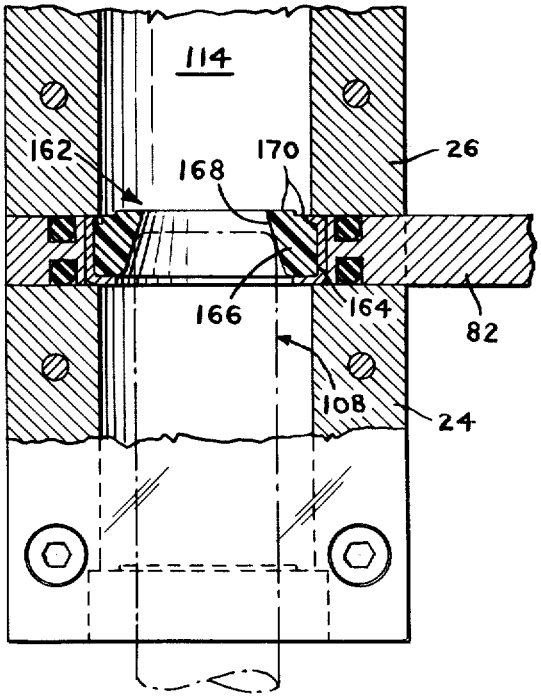
FIG. 16 is a still further enlarged view, similar to FIG. 13, illustrating the invention being utilized with a fourth type of sealing means.

In FIG. 16, as yet further type of sealing means 162 is shown in use with the present invention. The sealing means 168 is shown in precisely the environment that has been described in connection with FIGS. 13 through 15. Th seal again is seen to consist of a steel outer shell 164, and an inner elastomeric seal 168 secured to the outer shell. The shell 164 in turn, may be press-fitted within slide member 82, in a manner that has been previously described. Elastomeric seal 16 in the present instance, is so proportioned that the increasing pressure in chamber 114, acts almost entirely on the upper surfaces 170 of the elastomeric material. Again in the present instance, however, the forces ensuing from such pressure rise, are coupled through the body of elastomeric seal 166, so as to increase the force of contact between piston 108 and sealing surface 168. It will further be noted in the present instance, that piston 108 is shown approximately at its point of initial contact with sealing means 162. It may be assumed here that the seal 162 is "new"; and hence that no wear has as yet occurred. Inspection of the minimum I.D. of seal 166, will render evident how very considerable a degree of wear can occur before the I.D. of seal 166 will be enlarged to a point at which replacement is actually required.

In accordance with a further aspect of the present invention, the construction described in connection with FIGS. 6 through 9, i.e. the slideable displaceable member 82 including the plurality of sealing means, enables a most important result. In particular, it will be appreciated by reference, e.g. to FIG. 4, that upon a sealing means 96 becoming worn due to continued use of the pump 20, an operator can displace the member 82 in the direction of arrow 152, so as to bring the sealing means 96A into the position which in the drawing is occupied by sealing means 96. Following the seal substitution, the pump 20 may immediately resume operation with virtually no down-time. The "worn" seal will then clearly (see FIG. 12) be external of body 22, thus enabling immediate replacement of such worn seal. This replacement is, of course, facilitated by the fact that seal 96 is maintained in plate 84 by a simple pressure fit — which enables removal and replacement thereof in extremely simple fashion.

While the member 82 has been shown as rectangular in form and including only a single pair of sealing means, it is obvious that any reasonable further number of such seals may be incorporated on such a displaceable member in side-by-side fashion. Furthermore, it will be evident that the displaceable member 82 need not necessarily be adapted to a "linear" movement through the pump body. The plural seals rather, can be positioned on other carrier means enabling transverse movement thereof through the pump body so as to position the spaced seals (one-at-a-time) at the pressure chamber inlet. For example, the displaceable member may comprise a circular or annular plate, rotatable about an axis parallel to but displaced from the axis of bore 42. An arrangement of this latter type is generally, however, more cumbersome — and not as compact as one utilizing the simple rectangular plate previously described.

While the present invention has been particularly described in terms of specific embodiments thereof, it will be understood in view of the present disclosure, that numerous variations upon the invention are now enabled to those skilled in the art, which variations yet reside within the scope of the present teaching. Accordingly the invention is to be broadly construed and limited only by the scope and spirit of the claims now appended hereto.

We claim:

1. A metering pump for pumping quantities of a flowable liquid composition, comprising in combination:

a pump body including a bore for receiving said composition to be dispensed;

feed inlet means for providing said flowable composition to said bore;

a dispensing outlet means including check valve means for discharging said composition from said pump;

a pressure chamber being defined intermediate said feed inlet and dispensing outlet means; said chamber having an inlet, and an outlet communicating with said dispensing outlet through said check valve means;

a piston mounted for axial reciprocation in said bore between a first position whereat said piston is withdrawn from said pressure chamber inlet and whereat said feed inlet may communicate with said pressure chamber inlet to enable feed of said composition to said pressure chamber inlet, and a second position whereat said piston passes at least partially into said pressure chamber inlet;

said pressure chamber inlet being bounded by first sealing means including an annular sealing surface which converges in the direction of said pressure chamber for substantially its entire extension along the axis of said bore to a diameter less than that of said piston, whereby said surface may slideingly engage and seal with said piston upon said piston entering said pressure chamber; said sealing surface being elastically dilateable away from the axis of said bore to maintain the seal about said piston during entry and withdrawal from said pressure chamber and to compensate for wear; and at least one other surface of said sealing means being accessible to the interior of said pressure chamber, and elastically coupled to the backside of said sealing surface, whereby the increasing pressure developed by continued axial movement of said piston into said pressure chamber, acting through said accessible surface, increases sealing force between said sealing surface and piston;

and wherein said piston comprises a cylindrically shaped rod of generally uniform cross-section; the diameter of said rod being substantially less than that of said bore, to provide substantial clearance between said piston and the internal wall of said bore.

2. Apparatus in accordance with claim 1, wherein said sealing surface is defined at the radially inward side of a flexible sealing lip.

3. Apparatus in accordance with claim 1, further including second sealing means, sealingly engaging said piston at both said first and second positions at the point where said piston enters said pump body; said feed inlet means entering said pump body intermediate said first and second sealing means, whereby when said piston is withdrawn to said first position a partial vacuum is generated within said bore to draw said flowable composition therein.

4. Apparatus in accordance with claim 3, wherein said second sealing means is identical to said first sealing means.

5. A metering pump in accordance with claim 1, wherein said first sealing means are carried by a member which is transversely displaceable with respect to said bore; said member including a plurality of said first sealing means; and said member being manually displaceable to position one of said sealing means at said pressure chamber inlet while at least one other of said sealing means is simultaneously positioned external of said pump body to enable servicing or replacement thereof while the operation of said pump continues.

6. Apparatus in accordance with claim 5, wherein said first sealing means are press-fitted into circular openings formed in said displaceable member.

7. Apparatus in accordance with claim 6, further including O-ring seals mounted on said member about each said circular opening for sealing the periphery of said opening with the adjacent portions of said pump body.

8. Apparatus in accordance with claim 6, wherein said first sealing means comprises an elastomeric composition and is of one-piece construction.

9. Apparatus in accordance with claim 5, wherein said displaceable member is of generally rectangular shape, and wherein said pump body includes an opening there across for slideingly receiving the lateral edges of said displaceable member.

10. Apparatus in accordance with claim 9, wherein said displaceable member includes at least a pair of said sealing means spaced with respect to one another along the displacement axis of said generally rectangular member.

11. In a metering pump of the type adapted for pumping quantities of a flowable liquid composition, and including a pump body having a bore for receiving said composition, inlet means for providing said composition to said bore, dispensing outlet means for discharging said composition from said pump, a pressure chamber intermediate said feed inlet and dispensing outlet, piston means mounted for reciprocation in said bore, and sealing means at said pressure chamber inlet for sealing with said piston during pressurization by said piston of said chamber contents; the improvement comprising:

seal-carrying means transversely displaceable with respect to said bore, and carrying a plurality of said sealing means; said means being displaceable to position one of said sealing means at said pressure chamber inlet to seal with said piston, while at least one other of said sealing means is simultaneously positioned external of said pump body; whereby said plurality of sealing means may be interchanged to thereupon enable servicing or replacement of said externally positioned sealing means while the operation of said pump continues.

12. Apparatus in accordance with claim 11, wherein said seal-carrying means is of generally rectangular shape, and wherein said pump body includes an opening there across for slidingly receiving the lateral edges of said displaceable means.

13. Apparatus in accordance with claim 12, wherein said displaceable means includes at least a pair of said sealing means spaced with respect to one another along the displacement axis of said generally rectangular member.

14. Apparatus in accordance with claim 11, wherein said sealing means are press-fitted into circular openings formed in said displaceable means.

* * * * *